US009920574B2

(12) United States Patent
Robertson

(10) Patent No.: US 9,920,574 B2
(45) Date of Patent: Mar. 20, 2018

(54) IN SITU PUMP FOR DOWNHOLE APPLICATIONS

(71) Applicant: Robertson Intellectual Properties, LLC, Arlington, TX (US)

(72) Inventor: Michael C. Robertson, Mansfield, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 116 days.

(21) Appl. No.: 14/958,518

(22) Filed: Dec. 3, 2015

(65) Prior Publication Data

US 2016/0084009 A1 Mar. 24, 2016

Related U.S. Application Data

(63) Continuation-in-part of application No. 14/143,534, filed on Dec. 30, 2013, now Pat. No. 9,416,609, and a continuation-in-part of application No. 13/507,732, filed on Jul. 24, 2012, and a continuation-in-part of application No. 13/815,691, filed on Mar. 14, 2013, now Pat. No. 9,388,684.

(Continued)

(51) Int. Cl.

| | |
|---|---|
| ***E21B 17/14*** | (2006.01) |
| ***E21B 7/18*** | (2006.01) |
| ***E21B 47/09*** | (2012.01) |
| ***E21B 23/02*** | (2006.01) |
| ***E21B 29/00*** | (2006.01) |

(52) U.S. Cl.

CPC ..... *E21B 7/18* (2013.01); *E21B 23/02* (2013.01); *E21B 29/00* (2013.01); *E21B 47/09* (2013.01)

(58) Field of Classification Search

CPC ..... E21B 17/14; E21B 10/26; E21B 10/55; E21B 7/20; E21B 17/07; E21B 21/103; E21B 23/006; E21B 2034/002; E21B 23/02; E21B 29/005; E21B 29/06; E21B 33/14; E21B 17/1014; E21B 10/32; E21B 17/1078

See application file for complete search history.

(56) References Cited

U.S. PATENT DOCUMENTS 7,073,582 B2 * 7/2006 Connell ..... E21B 47/044 166/113
7,283,061 B1 * 10/2007 Snider ..... E21B 17/006 166/254.2

(Continued)

FOREIGN PATENT DOCUMENTS

WO WO2008093047 A1 8/2008

*Primary Examiner* — Zakiya W Bates

(57) ABSTRACT

An apparatus for providing pressurized fluid to a formation that includes a power source body configured to contain a gas-generating fuel and a tool body comprising a first chamber and a second chamber. The first chamber is configured to hold a fluid, and the second chamber is configured to receive gas from the gas-generating fuel within the power source body. The apparatus further comprises a piston sealed between the first chamber and the second chamber and configured to stroke through the first chamber in response to a pressure increase within the second chamber, and a hose configured to generate a high-pressure jet of the fluid and to extend from the tool body or a diverter sub into the formation when the piston strokes through the first chamber.

30 Claims, 12 Drawing Sheets

Related U.S. Application Data

(60) Provisional application No. 62/086,848, filed on Dec. 3, 2014.

(56) References Cited

U.S. PATENT DOCUMENTS

| | | | | |
|---|---|---|---|---|
| 7,766,083 | B2 | 8/2010 | Willett et al. | |
| 8,167,060 | B2 * | 5/2012 | Brunet | E21B 7/18 166/222 |
| 8,915,297 | B2 | 12/2014 | Surjaatmadja et al. | |
| 9,062,545 | B2 | 6/2015 | Roberts et al. | |
| 2004/0089450 | A1 * | 5/2004 | Slade | B24C 1/045 166/298 |
| 2011/0174504 | A1 * | 7/2011 | Wright | E21B 23/04 166/386 |
| 2012/0247758 | A1 | 10/2012 | Smith | |
| 2014/0102705 | A1 | 4/2014 | Dotson | |
| 2014/0251621 | A1 | 9/2014 | Smith et al. | |

* cited by examiner

IN SITU PUMP FOR DOWNHOLE APPLICATIONS

CROSS REFERENCE TO RELATED APPLICATIONS

The present application is a non-provisional application that claims priority to U.S. Provisional Application having Application Ser. No. 62/086,848, entitled "In Situ Pump For Downhole Applications," filed Dec. 3, 2014, and a continuation-in-part application that claims priority to U.S. patent application Ser. No. 14/143,534, entitled "Tool Positioning and Latching System," filed Dec. 30, 2013, U.S. patent application Ser. No. 13/507,732, entitled "Permanent Or Removable Positioning Apparatus And Method For Downhole Tool Operations," filed Jul. 24, 2012, and U.S. patent application Ser. No. 13/815,691, entitled "Modulated Formation Perforating Apparatus And Method For Fluidic Jetting, Drilling Services Or Other Formation Penetration Requirements," filed Mar. 14, 2013, all of which are incorporated in their entireties herein.

FIELD OF THE INVENTION

The present invention relates, generally, to downhole apparatus and methods usable for penetrating into a formation from a wellbore. More specifically, the embodiments of the present invention relate to an in situ pump apparatus and methods for penetrating into a formation and releasing hydrocarbons contained therein.

BACKGROUND

Hydraulic fracturing is used as a method to potentially increase hydrocarbon production in formations, such as sandstone, limestone, dolomite and shale. A well operator performs the following steps prior to hydraulic fracturing: First, the operator drills a wellbore into the formation and, then, he cases and cements the wellbore. Next, to gain access to the formation, the well operator blasts holes through the casing and cement using high explosives—a process called perforating. Then, to fracture the formation, the operator pumps high-pressure fluid through the perforations—typically gelled water or filtered hydrocarbons laden with chemicals, such as acids, surfactants, and proppants—into the wellbore to fracture the formation under immense hydraulic pressure.

Concerns that hydraulic fracturing may contaminate ground water with hydrocarbons from the formation, and/or chemicals associated with the fracturing processes, have recently brought hydraulic fracturing under public and legislative scrutiny. A recent report in the Proceedings of the National Academy of Sciences, entitled *Noble gases identify the mechanisms of fugitive gas contamination in drinking-water wells overlying the Marcellus and Barnett Shales*, by Thomas H. Darrah, et al. (vol. 111, pages 14076-81, Sep. 30, 2014, referred to herein as "the Darrah paper") detailed various modes by which hydrocarbons, from hydraulically fractured wells, could escape into groundwater. That paper concluded that the primary mode of contamination is via structural flaws in wellbore casing and cementing.

Several of the modes discussed in the Darrah paper are shown in FIG. 1, which illustrates a well 100 extending into an area 101 of earth. Between the top surface layer 102 and the target formation (a.k.a., producing formation) 103, area 101 may contain several other strata and formations, such as an aquifer 104 and multiple intervening formations 105 and

106. In a typical region of the Barnett shale play in north-central Texas, the target formation 103 may be about 6500-7500 feet below the surface, the aquifer 104 may typically be about 180-225 feet below the surface (located in the upper Trinity Limestone), and the intervening formations 105 and 106 may be various layers of limestone (e.g., Marble Falls Limestone) or shale.

The well 100 generally includes production tubing 107 extending into a wellbore 108. The wellbore 108 is typically cased with a casing string 109 that is cemented to the inner surface of the wellbore via a cemented annulus 110. Well 100 includes a vertical section 111 and a horizontal section 112. Horizontal section 112 contains fractures 113, as created by hydraulic fracturing.

One possible route by which hydrocarbons produced from the target formation 103 may access aquifer 104 is illustrated by arrows 114 and termed herein as a "deformation route." Intervening formations may include deformations, such as the deformation 115, which can provide a route by which hydrocarbons, from the target formation 103, can travel to aquifer 104. When the formation is fractured during hydraulic fracturing, the generated fractures 113 may facilitate hydrocarbon transfer from the target formation 103 to deformation 115.

A second possible route is illustrated as arrow 116 and is termed herein an "annulus-conducted route." As shown in FIG. 1, the intervening formation 106 includes a gas-rich pocket 117 that is penetrated by the well 100. Any imperfections in the cemented annulus 110, i.e., cracks or sections that are not adequately sealed between the wellbore and the casing, can provide a route for hydrocarbons to travel from the gas-rich pocket 117 to the aquifer 104. Also, imperfections in the annulus that extend into the target formation 103 can also provide a route for hydrocarbons to escape from the formation 103 to the aquifer 104.

Arrow 118 represents a third contamination route, in which contamination occurs via compromises in the casing 109. If the casing 109 is compromised with structural defects like cracks or holes, then hydrocarbons and fracturing fluids can escape into the aquifer 104 through those defects. That route is referred to herein as the "casing route." The Darrah paper concluded that the annulus conducted route 116 and the casing route 118 are primarily responsible for hydrocarbon contamination of ground water associated with the hydraulically fractured wells examined in that paper.

Another problem with hydraulic fracturing is that it requires massive amounts of water—amounts measured in millions of gallons for a single well. Water is in short supply in many areas where hydrocarbon production occurs, and the high water demand associated with hydraulic fracturing imposes a tremendous burden on municipalities in those areas. Moreover, the well operator must install an infrastructure for handling the water to be used for hydraulic fracturing, for storing that water, and mixing it with chemicals, such as acids, gels, foamers, foam breakers, salts, and other adjuvants. The spent fluids, which have been used for hydraulic fracturing, must also be stored, usually in large impoundment ponds, until the fluids can be remediated or disposed of.

The embodiments of the present invention provide in situ formation enhancement apparatus and methods, which are usable for penetrating into a formation and releasing hydrocarbons contained therein, and which solve the problems associated with damage to the wellbore due to the use of explosives and contamination of the surroundings.

SUMMARY

An apparatus for providing pressurized fluid, comprising a power source body configured to contain a gas-generating fuel, a tool body comprising a first chamber and a second chamber. The first chamber is configured to hold a fluid, and the second chamber is configured to receive gas from the gas-generating fuel within the power source body. The apparatus also includes a displacement member sealed between the first chamber and the second chamber and configured to stroke through the first chamber in response to a pressure increase within the second chamber, and a hose configured to generate a high-pressure jet of the fluid and to extend from the tool body, a diverter sub, or combinations thereof, when or after the displacement member is displaced or strokes through the first chamber for providing the pressurized fluid.

The apparatus further comprises a valve configured to release the gas from the second chamber through the hose when the displacement member strokes or is displaced. The tool body comprises a first inside diameter and a second inside diameter longitudinally disposed with respect to the first inside diameter, and the second inside diameter is greater than the first inside diameter when the displacement member strokes from the first inside diameter to the second inside diameter releasing the seal between the first chamber and the second chamber. One or more o-rings disposed upon the displacement member form the seal between the first chamber and second chamber, and the seal is a gas-tight seal.

In certain embodiments, the apparatus further comprises an intake coupling coupled to the displacement member. The intake coupling comprises ports configured to direct the fluid in the first chamber to the hose when the displacement member strokes. The hose may comprise a jet-drilling nozzle for providing the pressurized fluid into a target formation. The diverter sub may be configured to direct the hose laterally out of the apparatus as the displacement member strokes through the tool body. The fluid may comprise a viscosity modifier, a surfactant, an acid, a proppant, abrasive materials, gelled water, a bonding material, or combinations thereof.

The high-pressure jet of fluid, in certain embodiments, comprises fluid that is collected, filtered, stored, pressurized, or combinations thereof, from a wellbore or a surrounding formation while the apparatus is located at penetration zone of a target formation. In certain embodiments, a length of the hose within the tool body is at least twice as long as a length of the hose within the diverter sub. The displacement member may be a piston that strokes through the first chamber for providing the pressurized fluid. The hose may be configured to be driven through a target formation by the pressurized fluid, at least one nozzle on the hose, a mechanical drive, or combinations thereof.

The disclosed embodiments include an apparatus for jet-drilling a downhole production formation, comprising a tool body configured to be placed in a cased and perforated wellbore within the downhole production formation, at least one chamber within the tool body configured to contain a fluid, a piston initially positioned at one end of the at least one chamber and configured to stroke through a length of the at least one chamber, and a jet-drilling nozzle. The stroking of the piston forces the fluid through the jet-drilling nozzle and into the downhole production formation.

In certain embodiments, the piston is configured to enable a release of high-pressure gas into the downhole production formation after the fluid is forced into the downhole production formation. The jet-drilling nozzle can be removed from the apparatus prior to the release of the high-pressure gas. The jet-drilling nozzle may be configured to be removed from the apparatus by passing a solid material through the hose, passing a metallic material through the hose, passing an acid through the hose, or combinations thereof. The jet-drilling nozzle may comprise any number of orifices, any size of orifices, any configuration, and any shape of orifices for forcing the fluid into the downhole production formation.

The apparatus may include a number of orifices on the jet-drilling nozzle, sizes of the orifices on the jet-drilling nozzle, a ratio of the number of orifices on a leading edge to the number of orifices on a trailing edge of the jet-drilling nozzle that controls pressure of the pressurized fluid, a forward travel rate of the jet-drilling nozzle, and a cutting or perforating penetration of the jet-drilling nozzle. The chamber may be configured to contain the drilling fluid used for jet-drilling, and a second chamber may be configured to contain the fuel used to pressurize the jet-drilling performed by the apparatus within the wellbore.

The disclosed embodiments also include a method of generating a jet of high pressure fluid within a wellbore. The method comprises activating a gas-generating fuel contained within a fuel chamber of a downhole tool to produce an expanding gas, pressurizing a gas-expansion chamber of the downhole tool with the expanding gas, and stroking a displacement member through a fluid chamber configured to hold a fluid. The displacement member strokes due to pressurizing of the gas-expansion chamber and causes pressurizing of the fluid. The method also includes jetting the fluid out of an outlet of the downhole tool in response to the pressurizing of the fluid, and the jetting of the fluid creates a bore in a production formation surrounding the wellbore.

The step of creating the bore comprises extending a hose into the bore to enlarge the bore for forcing the fluid into the production formation, wherein the hose extends into the bore from a tool body, a diverter sub, or combinations thereof. The method further comprises removing a jet-drilling nozzle from the outlet prior to releasing the expanding gas by passing a solid material through the hose, passing a metallic material through the hose, passing an acid through the hose, or combinations thereof.

The method further comprises stimulating the production formation by releasing the expanding gas from the outlet after the fluid has been jetted. Releasing the expanding gas comprises releasing the expanding gas through a valve in the displacement member, releasing the expanding gas around the displacement member, or combinations thereof. The method further comprises performing well logging to produce logging data for identifying a target formation to create the bore and using the logging data to position the downhole tool at the target formation for creating the bore. The method further comprises using the logging data for re-entry of the downhole tool or a second downhole tool at prior target formation or the bore.

The method further comprises the method steps of deploying a positioning tool within a wellbore at a site of a target formation, wherein the positioning tool comprises a selective profile, and latching the downhole tool into the positioning tool, wherein the downhole tool comprises a profile complementary to the selective profile of the positioning tool for positioning the downhole tool at the target formation. The method further comprises using logging data, the positioning tool, or combinations thereof for re-entry of the downhole tool or a second downhole tool at prior target formation or the bore. The displacement member may be a piston or a crush cylinder.

A method of generating a jet of high pressure fluid within a wellbore, comprises activating a gas-generating fuel contained within a fuel chamber of a downhole tool to produce an expanding gas, pressurizing a gas-expansion chamber of the downhole tool with the expanding gas, and stroking a piston through a fluid chamber configured to hold a fluid. The piston strokes due to pressurizing of the gas-expansion chamber. The method also comprises jetting the fluid out of an outlet of the downhole tool in response to the stroking of the piston. The jetting of the fluid creates a bore in a production formation surrounding the wellbore

DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Explosively perforating a casing and cemented annulus of a wellbore as a precursor to hydraulic fracturing can contribute to groundwater contamination by causing cement damage and weakening of the casing-to-cement bond and the cement-to-formation bond. Cement damage can cause routes for hydrocarbons and fracturing fluid to escape from a hydrocarbon formation into the groundwater. Deluging the formation with massive amounts of fluid from the surface of the wellbore, as in hydraulic fracturing, can also compact the formation and trap large quantities of interstitial hydrocarbons, preventing extraction of those hydrocarbon deposits.

The in situ formation enhancement tool, described herein, addresses these problems. The in situ formation enhancement tool uses jets of high-pressure fluid, such as water or hydrocarbon, to bore into the formation. The fluid is carried downhole within the in situ formation enhancement tool rather than pumped downhole from the surface, as it is in hydraulic fracturing. The mechanism and fuel for pressurizing the fluid is also self-contained within the in situ enhancement tool.

Figure 1:
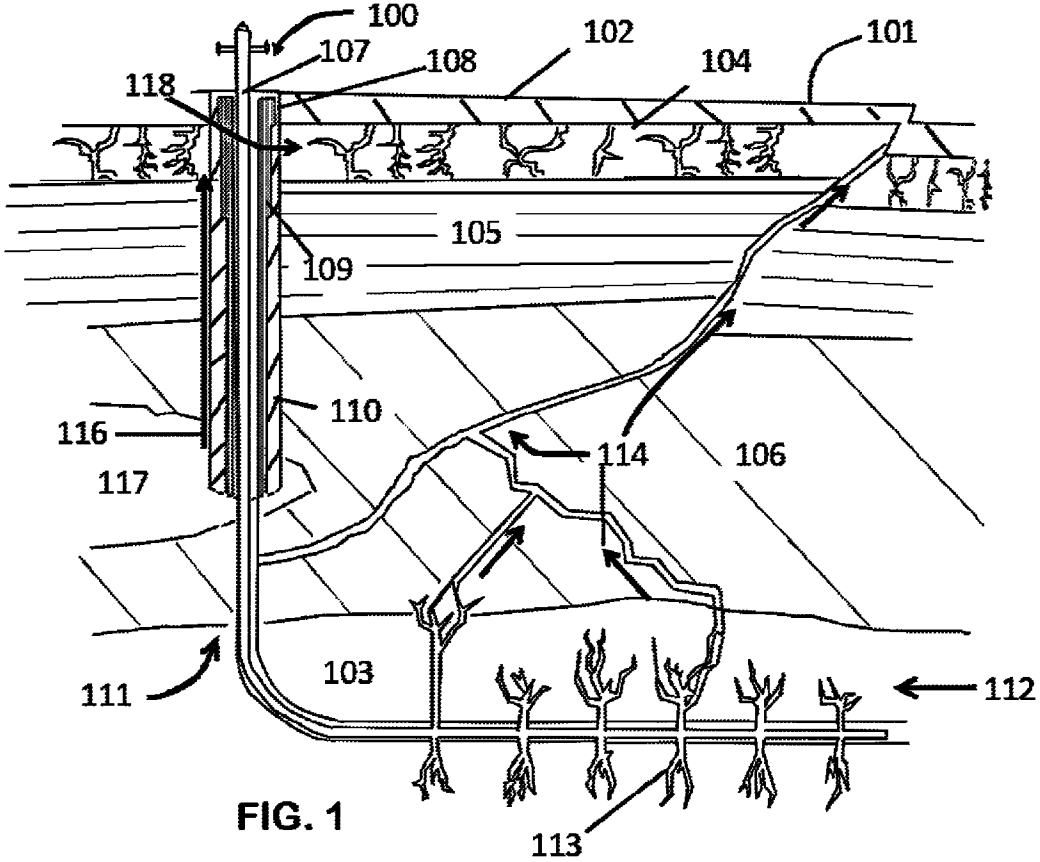
FIG. 1 illustrates modes of groundwater contamination associated with hydraulic fracturing.
Figure 2:
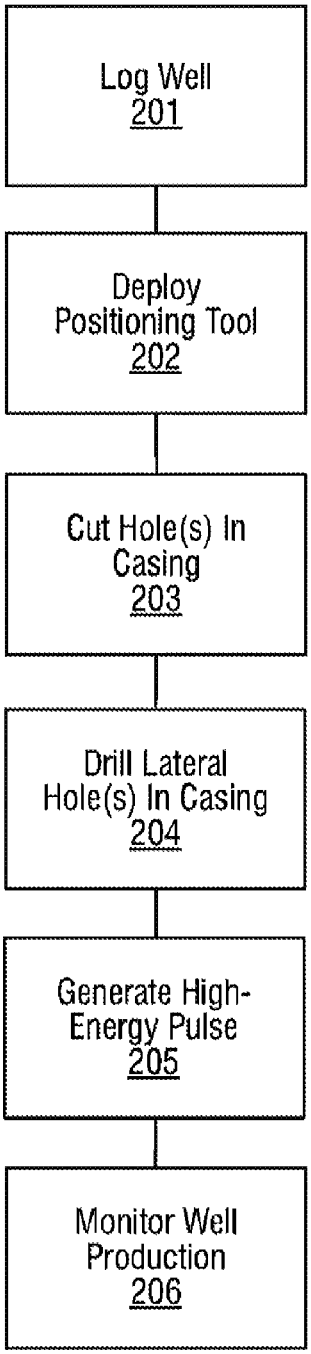
FIG. 2 is a flowchart illustrating a method of stimulating a formation.

FIG. 2 provides a flowchart overview of a method 200 for implementing the in situ enhancement tool described herein from the surface of a wellbore. First, to determine an effective location for implementation of the in situ enhancement tool, a well operator may perform one or more well logging steps 201 to identify regions of a well likely to produce hydrocarbons. Many well logging methods are known in the art, and it is within the ability of a person of skill in the art to decide which logging methods are appropriate for their given situation. Logging may be performed while drilling by incorporating sensors into the drilling string used to drill the well or by analyzing the drilling mud and formation cuttings that return to the surface during drilling. Logging may be performed after drilling by lowering logging tools into the wellbore via a wireline. Logging data may be based on one or more of many different observable properties of the formations within the well, including resistivity, acoustic properties, density, the interaction of the formation with radiation of different types, etc. By logging the well, the well operator seeks to identify where geological formations, which are likely to produce hydrocarbons, are located within the well. Those are the locations that the operator may choose to stimulate using the methods described herein.

Having identified a promising formation (target formation) within the wellbore, the operator can position the in situ enhancement tool within the wellbore, within that target formation, or within a nearby formation, any of which may be located thousands of feet from the surface hole of the wellbore. Moreover, it may be beneficial for an operator to perform multiple operations with multiple tools. For multi-run operations, an operator may position the equipment within the target formation, trigger the operation, bring the equipment to the surface, and subsequently re-enter and reposition the equipment or other equipment in the same exact position within the target formation. The positioning, in addition to the re-entry and repositioning of the downhole tool and other equipment may be accomplished by using the Tool Positioning and Latching System described by MCR Oil Tools, LLC. and disclosed in U.S. Patent Application Pub. No. 2015-0184476, filed Nov. 24, 2009, which is incorporated by reference in its entirety herein. In addition, or alternatively, the positioning, re-entry, and repositioning of the downhole tool and other equipment may be accomplished by using the Permanent or Removable Positioning Apparatus and Methods for Downhole Tool Operations described by MCR Oil Tools, LLC and disclosed in U.S. Patent Application Pub. No. 2013/0025883, filed Jul. 24, 2012, which is incorporated by reference in its entirety herein. With regard to the positioning and latching systems of MCR Oil Tools, LLC, the well logging may be performed to identify the target formation, and then the downhole tool (i.e., in situ formation enhancement tool) can be deployed with the use of the positioning tool 202. The operator can deploy the positioning tool 202 within the wellbore, typically placing the apparatus a few feet below the exact target position within the wellbore, to allow the operator to reliably reposition the enhancement apparatus at the target. As discussed above, U.S. Patent Application Publication No. 2013/0025883, describes and discloses the downhole positioning tool provided by MCR Oil Tools, LLC, which can be used to reproducibly position the enhancement apparatus within the target formation. Briefly, the positioning tool described in that application features a slip system for anchoring the positioning tool within a wellbore and a system of grooves for interfacing with complimentary protrusions on a downhole tool, or vice versa, such as the enhancement apparatus described herein. Once anchored, the positioning tool allows the enhancement apparatus to be reproducibly deployed to the same location within the wellbore. As an alternative to the positioning tools described above, any MCR Oil Tools, LLC anchoring systems can be used for positioning the downhole tool at the target formation.

Once the positioning tool is anchored within the wellbore, the operator uses the in situ enhancement tool or a torch to cut or perforate a hole in the casing 203. Cutting or perforating through the casing enables the enhancement apparatus to perform operations on the cemented annulus and the formation without explosively perforating the casing (and damaging the surrounding cement). Examples of suitable torches for cutting or perforating the casing are provided by MCR Oil Tools, LLC, and described in U.S. Pat. Nos. 6,186,226, 7,690,428, and 8,020,619. Specific examples of suitable torches include MCR's Perforating Torch Cutter™ tool or MCR's Perforating Pyro Torch® tool, both available from MCR Oil Tools (Arlington, Tex.). Once the torch is in position, the operator activates the torch to cut or perforate a hole in the casing. According to some embodiments, the torch may cut or perforate a single hole in the casing. In other embodiments, the torch may be configured to cut or perforate multiple holes in the casing. For example, the torch may be configured to cut four holes in the casing, each hole at the same depth and spaced 90° from each other about the inside diameter of the casing.

With one or more holes cut in the casing and the cemented annulus exposed to the inside of the wellbore, the operator can remove the torch or the in situ enhancement tool from the wellbore and deploy the next in situ enhancement tool into the wellbore. The in situ enhancement tool is described in detail below. Like the torch, the in situ formation enhancement tool can be configured to interface with the downhole positioning tool, allowing the in situ formation enhancement tool to align with the hole(s) in the casing.

Once aligned with the hole, the operator activates the in situ formation enhancement tool. When the in situ formation enhancement tool receives an activation signal (e.g., a countdown finishing, a specific condition reached, or a wireless or wired signal sent to the in situ formation enhancement tool), the in situ formation enhancement tool uses high-pressure jets of fluid to bore 204 through the cement and into the formation. The fluid is pressurized within the in situ formation enhancement tool by compressing the fluid. Compression of the fluid may be accomplished in a number of ways including using a non-explosive gas-generating fuel that is also contained within the in situ formation enhancement tool, an electro-mechanical pump, a spring-loaded piston, or other chemical, mechanical, or electrical pressurizing apparatus. As explained in more detail below, a quick way of pressurizing the fluid may be to use gas generated by burning fuel within the in situ enhancement tool to actuate the piston that compresses the fluid. The fuel that is burned can include such characteristics as having a selected mass flow rate, a selected burn rate, or combinations thereof, which can be adapted to create the amount of pressure needed to displace the piston within the downhole tool. The type of fuel selected for use can be dependent upon such characteristics as the hydrostatic pressure between the tool body and the target formation, the temperature at the cutting or perforation site, presence or lack of circulation within the wellbore, and other conditions relating to the wellbore and/or the target formation. Specifically, in an embodiment, the fuel of the downhole tool can be configured to provide a desired mass flow and/or burn rate, e.g., through use and relative orientation between different fuel types, and/or fuel sources having differing shapes or physical geometries. The mass flow and/or burn rate can be selected based on various wellbore conditions, the thickness of the casing and/or target formation to be perforated or cut, such that a bore through the casing and/or target formation can be efficiently formed, without any contamination or damage to the surrounding areas. In calculating the amount of fuel required for forming the bore through the casing and/or the target formation, an additional quantity of fuel may be required to generate the expulsion and removal of the cuttings of the casing, tailings of the cement, or other debris formed through the cutting and/or perforating of the bore. As such, the amount of fuel is calculated, and the type of fuel is selected for not only generating the pressure needed for penetration of the casing and/or target formation in forming the bore, but also for removal of the cuttings, tailings, and other debris generated by the cutting and perforating of the casing and/or the target formation.

An electromechanical pump (e.g., electromechanical rotating pump, diaphragm pump, etc.) may also be used to drive the piston through a fluid-storage chamber. The stroking piston forces the fluid through an extending hose and, in some embodiments, through a jet nozzle, which can bore into the formation. The in situ formation enhancement tool can drill a lateral bore several feet into the formation, for example, about 2 to about 20 feet. The lateral bore may be about one (1) centimeter (0.394 inches) to about five (5) centimeters (1.968 inches) or more in diameter.

If multiple holes were cut or perforated into the casing using the torch in step 203, then the operator may retrieve the in situ formation enhancement tool, reset the tool, and send the in situ formation enhancement tool back into the formation to drill another lateral bore. Again, the positioning tool, set in step 202, can facilitate this resetting and redeployment process by enabling the operator to reliably position the in situ formation enhancement tool at the proper location within the wellbore, i.e., where the torch perforated the casing. Once so positioned, the in situ formation enhancement tool can drill another lateral bore, repeating the sequence described in step 204.

At step 205, the formation is stimulated by subjecting the surface area of the one or more lateral bores extending into the formation to a high-energy impulse. According to one embodiment, the in situ formation enhancement tool can generate the high-energy impulse. Alternatively, the operator may retrieve the in situ formation enhancement tool from the wellbore and deploy a pulse-generating tool into the wellbore for generating a high-energy impulse. An example of a pulse-generating tool is described in more detail below. It uses a gas-generating fuel to generate high-pressure gas and then quickly releases that high-pressure gas to generate a high-energy pulse. The high-energy pulse transmits through the fluid within the lateral bores and impacts the surface of the formation within the lateral bores, causing the formation to crumble and release interstitial hydrocarbon.

Following stimulation using the high-energy pulse, the formation is typically allowed to produce for some length of time. Typical lengths of time can range from a few weeks to a few years. A specific example is about six months. At step 206, the well production is monitored, and the well operator may repeat the steps of method 200 if the amount of produced hydrocarbons slows or drops off.

Figure 3:
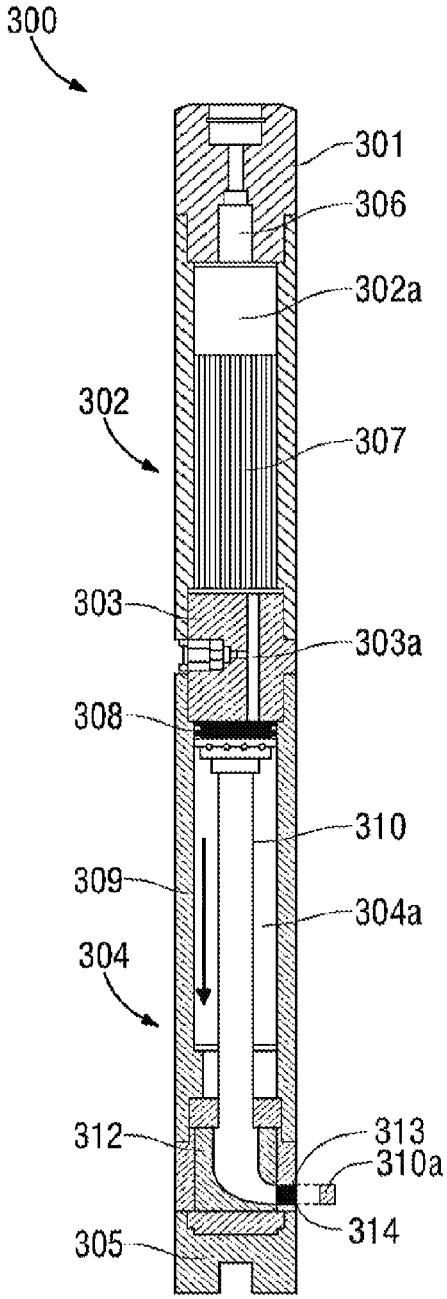
FIG. 3 illustrates an in situ formation enhancement tool, as described herein.

FIG. 3 illustrates an embodiment of an in situ formation enhancement tool 300. The illustrated tool has the following primary sections: isolation sub 301, power source body 302, bleed sub 303, tool body 304, and placement sub 305. Other embodiments may include additional or alternative sections, including mechanical or electromechanical pumps, springs, or other fluid-pressurizing machines, apparatuses, or methods.

Isolation sub 301 connects the in situ formation enhancement tool 300 to a conveyance mechanism. The conveyance mechanism is typically a slickline, e-line, workover string, or the like. Isolation sub also contains an activating mechanism 306 for activating power source 307 (described in more detail below). Examples of suitable activators include Series 100/200/300/700 Thermal Generators™ available from MCR Oil Tools, LLC, located in Arlington, Tex.

In operation, the power source body 302 contains a power source 307 that is capable of producing gas in an amount and at a rate sufficient to pressurize and operate tool 300. Power source 307 may be considered an "in situ" power source or fuel, because it is situated downhole during operation instead of on the surface. In situ power generation has the advantage that little, if any, communication is required between in situ formation enhancement tool 300 and the surface to pressurize the tool.

Examples of suitable power source materials are provided by MCR Oil Tools, LLC, as described in U.S. Pat. No. 8,474,381, issued Jul. 2, 2013, the entire contents of which are hereby incorporated herein by reference. Power source materials can include or utilize thermite or a modified thermite mixture. The mixture can include a powdered (or finely divided) metal and a powdered metal oxide. The powdered metal can be aluminum, magnesium, etc. The metal oxide can include cupric oxide, iron oxide, etc. A particular example of thermite mixture is cupric oxide and aluminum. When ignited, the flammable material produces an exothermic reaction. The material may also contain one or more gasifying compounds, such as one or more hydrocarbon or fluorocarbon compounds, particularly polymers.

The power source 307 is contained within a fuel chamber 302*a* of the power source body 302. Once activated, the power source 307 generates gas, which can expand and fill the fuel chamber 302*a*. The gas can expand through a conduit 303*a* of the bleed sub 303 and can impinge on a piston 308, which is contained within the tool body 304. Under the pressure of the impinging gas, the piston 308 moves (i.e. strokes) in the direction indicated by arrow 309, within a fluid chamber 304*a* of the tool body 304.

The fluid chamber 304*a* contains a fluid (e.g., hydraulic fracturing fluid), which becomes pressurized under the pressure generated by the piston 308 as the piston strokes. The fluid, in certain embodiments, is stored within the fluid chamber 304*a* at the surface of the wellbore and travels with the in situ enhancement tool 301 to the production formation. In other embodiments, the fluid may be collected, filtered, stored, and/or pressurized from the formation while the in situ enhancement tool is located at the formation. That is, the in situ enhancement tool may use surrounding fluid, even production fluid for example, to pressurize and jet out of the in situ enhancement tool to create a bore. As shown in FIG. 3, the piston 308 is coupled to a hose 310 via an intake coupling 311. The piston 308, intake coupling 311, and hose 310 are shown in more detail in FIG. 4 and discussed in more detail below. Here, it need only be understood that the fluid in the fluid chamber 304*a* is forced into the hose 310 through the intake coupling 311 and flows through the hose under very high pressure.

As the hose 310 is pushed downward in the direction indicated by arrow 309, the hose 310 is fed through a diverter sub 312 that is within the tool body 304. The diverter sub 312 deflects the hose 310 so that the hose 310 is pushed out of the tool body 304 through an opening 313. A dashed hose 310*a* in FIG. 3 illustrates the hose being pushed out of the in situ formation enhancement tool 300. The hose 310 can be capped with a nozzle 314, and the nozzle 314 can be used to generate a high-pressure jet for jet drilling into the cemented annulus and the formation, as explained in more detail below.

Figure 4:
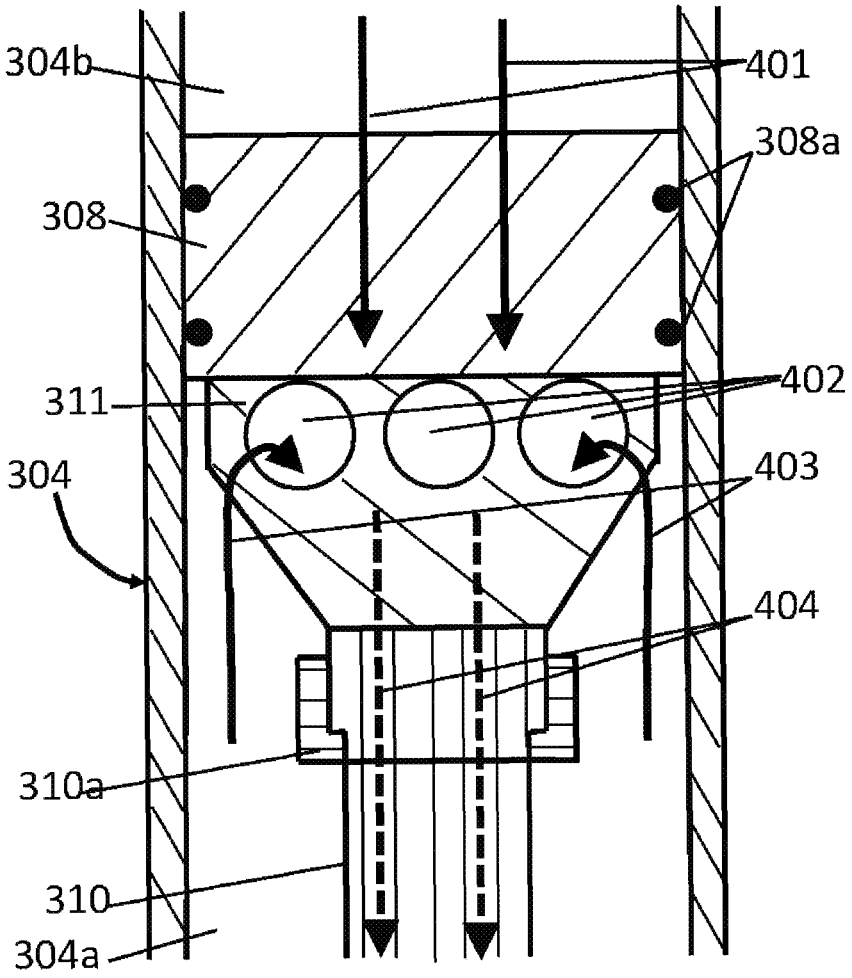
FIG. 4 illustrates a piston and fluid intake coupling, as used in embodiments of an in situ formation enhancement tool, as described herein.

FIG. 4 illustrates the piston 308 mid-stroke as it strokes within the tool body 304. The piston 308 includes o-rings 308*a*, which can form a gas-tight seal between the piston 308 and the inside diameter of the tool body 304. The piston 308 may be made of steel and can include grooves for containing the o-rings 308*a*.

The gas-expansion chamber 304*b*, shown in FIG. 4, can be filled with gas generated by the power source 307, as illustrated in FIG. 3. As the power source continuously generates gas, the pressure within the chamber 304*b* can increase and continue to push the piston 308 in the direction indicated by the arrows 401.

The fluid chamber 304*a* can contain fluid that is used to jet drill into the cased annulus and formation. As the piston 308 strokes, the fluid in the fluid chamber 304*a* is forced into the ports 402 of the intake coupling 311, as indicated by the arrows 403. The fluid is further forced through the hose 310 in the direction indicated by the dashed arrows 404.

The fluid can be tailored to the particular application and to the formation to be drilled. For example, the fluid may be acidic for drilling through acid-soluble cement and strata. The fluid may include viscosity modifiers, surfactants, acids such as hydrochloric acid (e.g. 15%) or a combination of hydrochloric and hydrofluoric acid (12%/3%, e.g.), proppants, and/or abrasive materials, gelled water, or a bonding material such as waterglass. As mentioned above, the fluid may also be collected and filtered from fluid surrounding the in situ enhancement tool 301.

The intake coupling 311 can be milled from steel to provide an internal flow path from the ports 402 to the hose 310. However, other materials can be used, such as durable, pressure resistant plastics or ceramics. The hose 310 can be coupled to the intake coupling 311 using a threaded connector 320, or generally any connector known in the art. The hose 310 can be a high-pressure hydraulic hose capable of sustaining high pressures. Before the hose 310 extends from the opening 313, however, the pressure inside of the hose 310 is the same as the pressure within the fluid chamber 304*a*. Therefore, for the section of hose 310 that remains within the fluid chamber 304*a*, there is a no significant pressure differential between the volumes inside of the hose (e.g., arrows 404) and outside of the hose 310 (e.g., arrows 403).

Figure 5A:
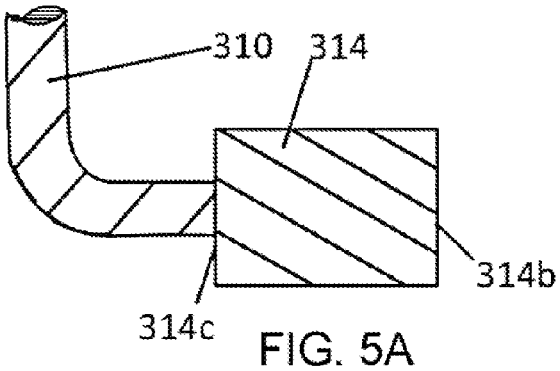
FIGS. 5A-5D illustrate embodiments of a jet-drilling nozzle.
Figure 5D:
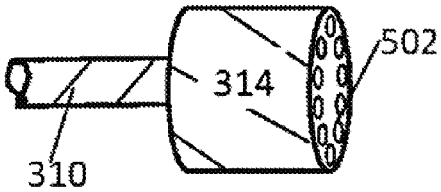
Figures 5B, 5C:
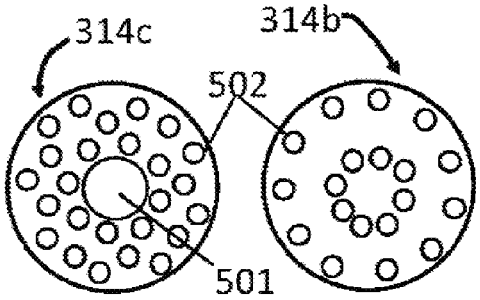

As the piston 308 strokes, the fluid is forced through the hose 310 and out of the nozzle 314. FIGS. 5A-5D illustrate embodiments of the hose 310 and the nozzle 314. The nozzle 314 can be connected to the hose 310 by a threaded connection 501, as shown in FIG. 5C for example. The nozzle 314 comprises a leading edge 314*b* and a trailing edge 314*c*, which are illustrated in FIGS. 5B and 5C, respectively. FIG. 5D illustrates a perspective view of nozzle 314. Both leading edge 314*b* and trailing edge 314*c* include orifices 502 for discharging jets of fluid which are shown in FIGS. 5B, 5C, and 5D.

Figure 6:
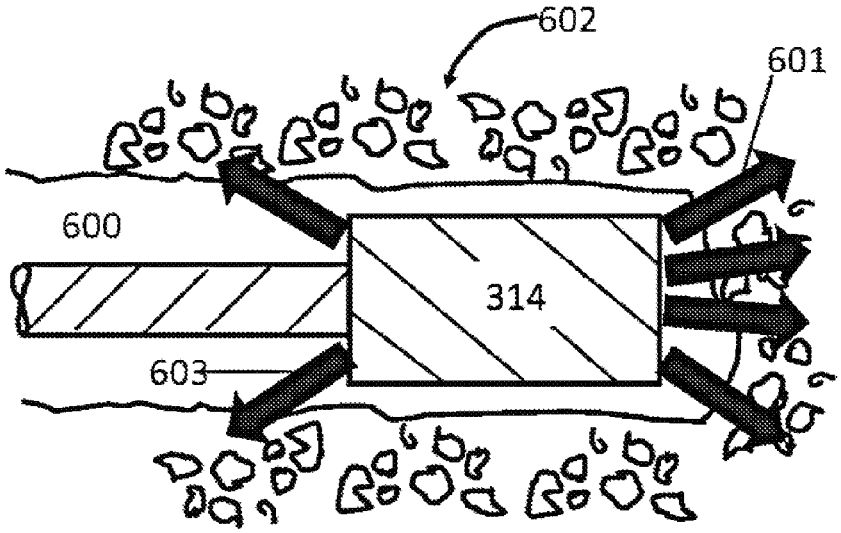
FIG. 6 illustrates implementation of a jet-drilling nozzle.

FIG. 6 illustrates how the nozzle 314 drills a lateral bore 600. Fluid 601 jetting out of the orifices on the leading edge of the nozzle 314 can drill into the formation 602 (or into the cemented annulus) while fluid 603 jetting out of the trailing edge helps propel the nozzle forward. The total number of orifices, the placement of the orifices, the sizes of the orifices and the ratio of numbers of orifices on the leading edge and the trailing edge can be sized to control the pressure (choke) of the fluid, the forward travel rate of the nozzle, and the cutting or perforating penetration of the nozzle. In certain embodiments of the nozzle 314, there are between 1 to about 6 orifices on the leading edge and between about 3 to about 12 orifices on the trailing edge. The orifices 502, in certain embodiments, may be about 0.07 millimeters (0.0028 inches) to about 1.5 millimeters (0.059 inches) in diameter. In other embodiments, the orifices 502 may include other sizes or shapes, including oval, square, rectangular, or other shapes to form a jet for fracturing the formation. While the nozzle 314 illustrated in the embodiments of FIGS. 5A-D and FIG. 6 is cylindrical, the nozzle 314 may have a different shape, such as conical or spherical, and may include orifices 502 formed on other sides and/or faces of the nozzle 314.

Figure 7:
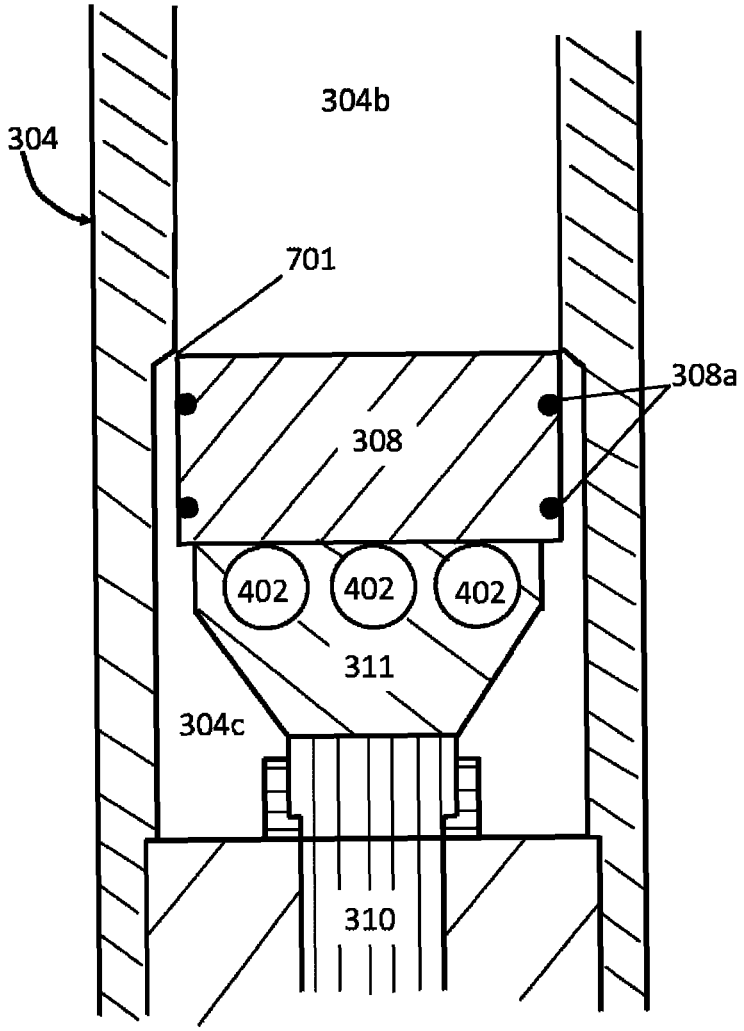
FIG. 7 illustrates a configuration for bleeding gasses from within an in situ formation enhancement tool, as described herein.

Once the hose 312 has been fully extended into the formation, the gas expansion chamber 304*b* (FIG. 4) will typically still contain an amount of highly pressurized gas that needs to be bled out of the chamber before returning the in situ formation enhancement tool 300 to the surface. According to some embodiments, the residual high-pressure gas can be vented into the lateral bore, generating a high-energy pulse that stimulates the formation. One configuration for venting the high-pressure gas is illustrated in FIG. 7. As the piston 308 moves within the chamber 304*b*, o-rings 308*a* form a gas-tight seal between the piston 308 and the inside diameter (I.D.) of chamber 304*b*. To vent the gas, the tool body 304 can include a section 304*c* having an enlarged I.D. so that, when the piston is within that section, the o-rings no longer form a gas-tight seal. So as the intake assembly 311 comes to rest at the bottom of section 304*c*, pressurized gas within the gas expansion chamber 304*b* can pass into the section 304*c* via an interface 701 between the piston and the I.D. of the tool body 304. Then, the pressurized gas can escape from the section 304*c* via the intake coupling ports 402, and the pressurized gas can escape into the formation via the hose 310.

Figure 8:
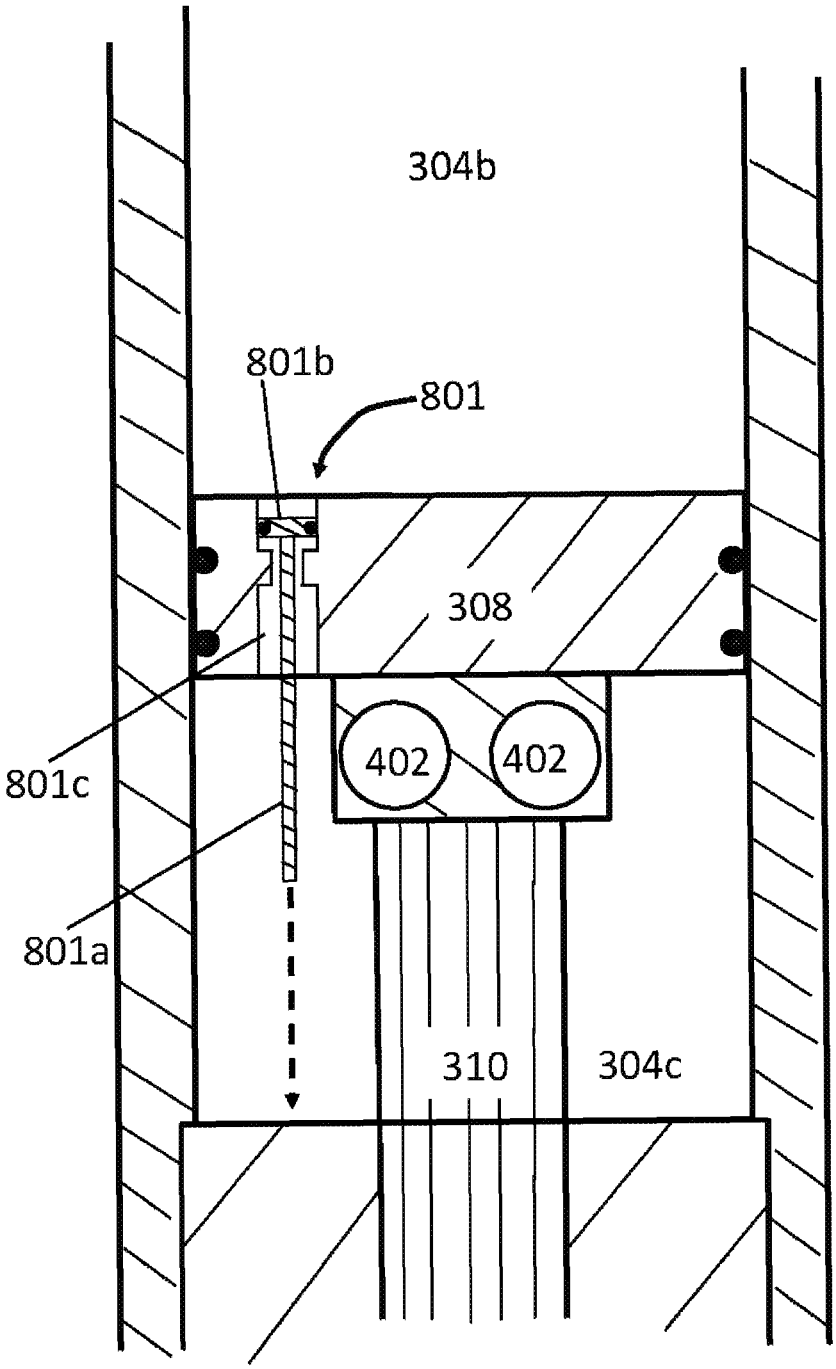
FIG. 8 illustrates an alternative configuration for bleeding gasses from within an in situ formation enhancement tool, as described herein.

FIG. 8 illustrates an additional embodiment of a configuration for venting high-pressure gas from within the chamber 304*b*. According to that embodiment, the piston 308 is configured with a plug valve 801. The plug valve 801 is closed while the piston is stroking, isolating the gas-generation chamber 304*b* from the fluid chamber 304*c*. As the piston 308 strokes, however, a bottom portion 801*a* of the plug valve 801 contacts the bottom of the fluid chamber 304*c* (indicated by the dashed line). The contact forces the plug member 801*b* out of the orifice 801*c*, thereby opening the plug valve 801. When the plug valve 801 opens, pressurized gas within the gas-generation chamber 304*b* can pass into the fluid chamber 304*c*. The pressurized gas can then escape into the formation via intake coupling ports 402 and the hose 310. Other valve types known in the art may also be capable of opening when the piston completes its stroke. Moreover, multiple valves may be used on a single piston 308.

Venting the pressurized gas is a safety precaution; a highly pressurized container could be dangerous to open at the surface. Moreover, releasing the pressurized gas before retracting the tool provides other advantages—the release of the pressurized gas downhole generates an impulse that can stimulate production within the formation.

Referring again to FIG. 6, arrows 601 and 603 represent streams of fluid jetting out of the orifices on the nozzle 314. Stimulating the formation occurs after the piston 308 of the in situ formation enhancement tool 301 has completed its stroke. At that point, the bore 600 is filled with fluid and no more fluid is jetting from the nozzle. The remaining pressurized gas within the tool is released passed the piston 308 and into the hose, as explained above. The arrows 601 and 603 can also represent highly pressurized gas that is being released into the lateral bore 600 and into the formation 602 during stimulation. The highly pressurized gas can create an impulse through the fluid within the bore 600 and can permeate the formation 602 at the interface, and dissipate the gas volume into the micro-fissures of the formation 602 and the bore 600, thereby enlarging the micro-fissures and stimulating the release of hydrocarbons that are entrapped within interstices of the formation matrix.

Figure 9B:
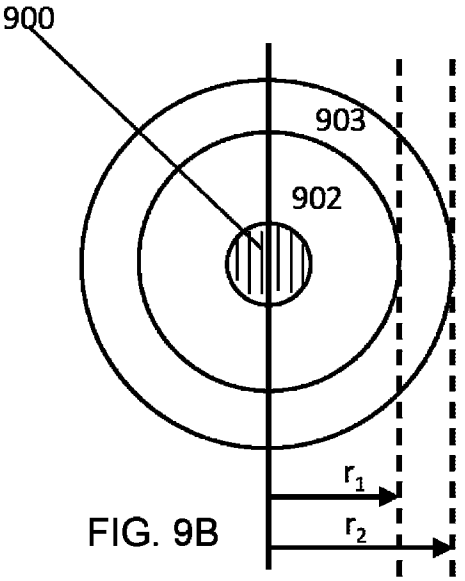
FIGS. 9A and 9B illustrate an invaded zone of a wellbore.
Figure 9A:
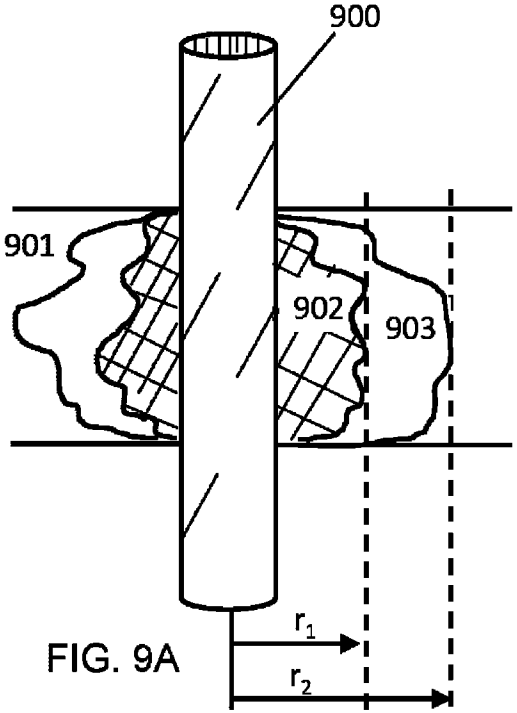

Subjecting the jet drilled lateral bore to an intense pulse of compressed gas is more effective than traditional hydraulic fracturing for several reasons. One advantage is that the lateral bore provides access to virgin formation, that is, a region of the formation that has not been penetrated by drilling mud and drilling mud filtrate when the wellbore was drilled. FIGS. 9A-B illustrate a mud-containing borehole 900 in cross section (FIG. 9A) and in cross-sectional view (FIG. 9B). Borehole 900 could be a borehole resulting from overbalanced drilling into a formation 901, for example. Formation 901 is porous, so drilling mud will tend to penetrate into the formation from the wellbore. The drilling mud is a slurry that comprises solid components suspended in a liquid. As the drilling mud penetrates into the formation, the solid components (referred to as filter cake) 902 penetrate a distance $r_1$, whereas the liquid components (referred to as filtrate) 903 penetrate further, a distance $r_2$. The zone of the formation that is penetrated by filter cake and/or by filtrate is referred to as the invaded zone (it is "invaded" by filter cake and filtrate). Native mobile fluids present within the invaded zone are forced out of the invaded zone and into the surrounding formation and are replaced by the invading filter cake and filtrate.

The invaded zone is a potential barrier that can prevent hydrocarbons from diffusing from the formation into the wellbore. That barrier may extend a few feet into the formation. As mentioned above, explosive perforating guns generate perforations through the casing, the cemented annulus, and perhaps several inches to several feet into the formation, but do not extend into the formation past the invaded zone. As a result, when the wellbore is pressurized with high pressure fracturing fluid, the force on the formation is concentrated within the invasion zone and not within the virgin formation, where the hydrocarbons are located.

In contrast to the perforations used during traditional hydraulic fracturing, the jet drilled lateral bores of the presently disclosed method extend past the invaded zone and into the virgin formation. When those lateral bores are subjected to an intense pulse of compressed gas, the power of that impulse impacts the virgin formation, where the hydrocarbons are located. Moreover, the lateral bores provide routes for the high pressure gas to invade the micro-fissures located in the virgin formation (e.g., outside of $r_2$) and a pathway for the hydrocarbons to reach the wellbore, bypassing the barrier created by the invaded zone.

Another drawback to traditional hydraulic fracturing is that the fracturing damages the formation in the region of the created fractures by forcing matter, known as fines, into the formation and clogging the porosity of the formation in the vicinity of those fractures. Examples of matter that can be forced into the formation include crushed grains of rock, crushed proppants, drilling mud and fluid and the like. The region of damage around the fractures created during hydraulic fracturing is referred to as "fracture face skin" (FFS).

Figure 10:
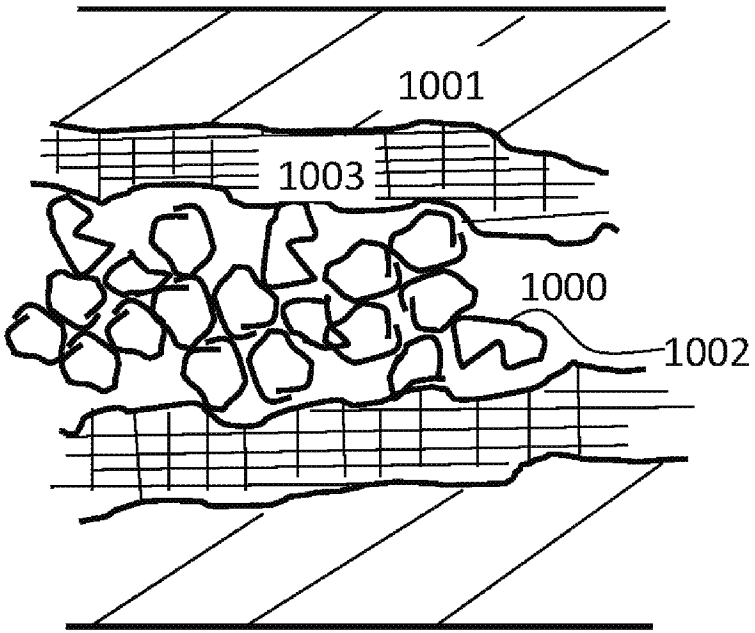
FIG. 10 illustrates formation damage caused by hydraulic fracturing.

FIG. 10 illustrates a fracture 1000, as is created during traditional hydraulic fracturing of a formation 1001. The formation is subjected to tremendous hydraulic pressure during the fracturing stage. That pressure can compress the formation and close the micro-fissures of the formation thereby destroying the gas producing mechanism of the gas bearing shale formation. Also, the hydraulic fracturing fluid typically includes a proppant material 1002, a portion of which can be pulverized under the immense hydraulic pressure. The proppant material is typically a ceramic material or frac-sand and is included in the frac fluid to "prop" the facture open. The hydraulic pressure forces the fines, pulverized proppant, and other unconsolidated small particles into the formation, creating the FFS 1003. The FFS reduces the permeability of the formation at the fracture face and can substantially hinder inflow from the formation.

Unlike traditional hydraulic fracturing, the well stimulation process described herein does not deluge the formation with massive amounts of water, gels or other concoctions. Instead, the fluid contained within the lateral bore 600 (FIG. 6) is at essentially hydrostatic pressure. Creating an impulse within the lateral bore by releasing high-pressure gas is akin to striking the formation with a hammer. The impulse causes the micro-fissures to propagate within the formation, thus enhancing the gas producing mechanism of the shale formation but does not compact the formation or force a substantial amount of liquid or materials into the formation. Continuing the analogy, traditional hydraulic fracturing is more akin to crushing the fracture face under a steamroller.

Figure 11:
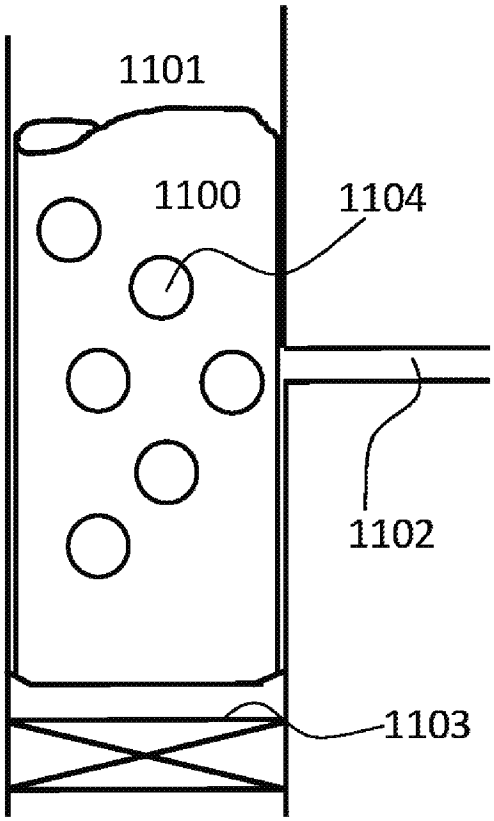
FIG. 11 illustrates an embodiment of an apparatus for generating a high-energy impulse using a gas-generating fuel.

An alternative method of generating an energetic impulse within the lateral bore is to remove the in situ formation enhancement tool and replace it with a dedicated impulse-generating tool, as illustrated in FIG. 11. The impulse-generating tool 1100 is positioned within a wellbore 1101 having a lateral bore 1102. The impulse-generating tool can be properly positioned within the wellbore using the same positioning tool 1103 that was used to position the in situ formation stimulation tool.

The impulse-generating tool 1100 can be simply a ported sub having ports 1104. The sub may be configured to contain a gas-generating fuel similar to that used to power the in situ formation enhancement tool 300. When sufficient gas pressure has built up within the impulse-generating tool, the gas is released, causing an impulse. The impulse causes the micro-fissures to propagate within the formation, thus enhancing the gas producing mechanism of the shale formation, as described above.

The impulse-generating tool is a chamber that is fed by a power source similar to the power source used in the in situ formation enhancement tool 300. The power source can be activated by an electrical impulse on e-line or an electrical impulse from an activator run on slickline. The gas power generated by the power source can enter the chamber and increase in pressure until the point where a rupture disk or valve system is overpowered to the point of opening. Once this point is achieved, the high-pressure gas is "dumped" into the formation at a high rate. The impulse causes the micro-fissures in the formation to propagate within the formation, thus enhancing the gas producing mechanism of the shale formation and gas production is enhanced. This all occurs without damage to the formation or alteration of the formations ability to produce.

Figure 12:
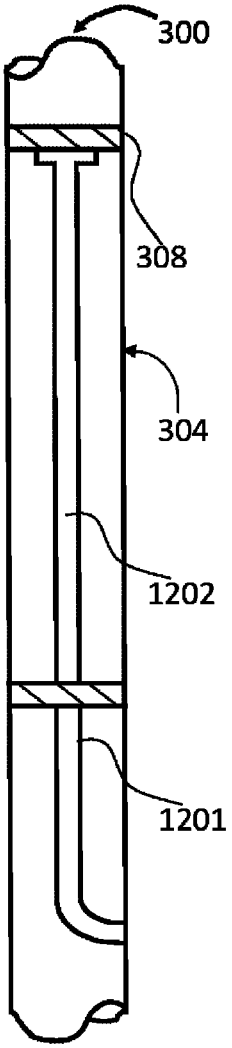
FIG. 12 illustrates an embodiment of an in situ formation enhancement tool, having a long stroke length.

FIG. 12 schematically illustrates a section of the in situ formation enhancement tool 300 wherein the piston 308 is within the tool body 304. It can be understood or assumed that the section of hose 1201, which is within the diverter sub 312, will be all of the hose that will penetrate into the formation when the lateral bore is jet drilled. For example, the section of hose 1201 may be about two meters long and may ultimately penetrate two meters into the formation; boring a two-meter lateral bore. Jet drilling two meters through the formation requires a certain volume of fluid; that volume must be contained within the tool body 304. To accommodate an adequate volume of fluid, the tool body 304 may be longer than the diverter sub 312. For example, the tool body may be about 4 to 8 meters long and the diverter sub may be about 2 to 3 meters long.

If the tool body 304 is twice as long as the diverter sub 312, then the hose 1202 within the tool body must also be twice as long as the hose 1201 within the diverter sub. When the piston 308 strokes, it will push twice as much hose as will penetrate into the formation.

Figure 13A:
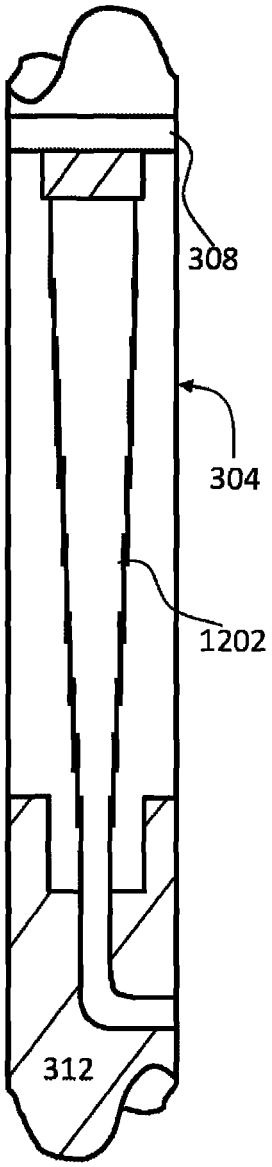
FIGS. 13A and 13B illustrate an embodiment of an in situ formation enhancement tool, having a telescoping hose.
Figure 13B:
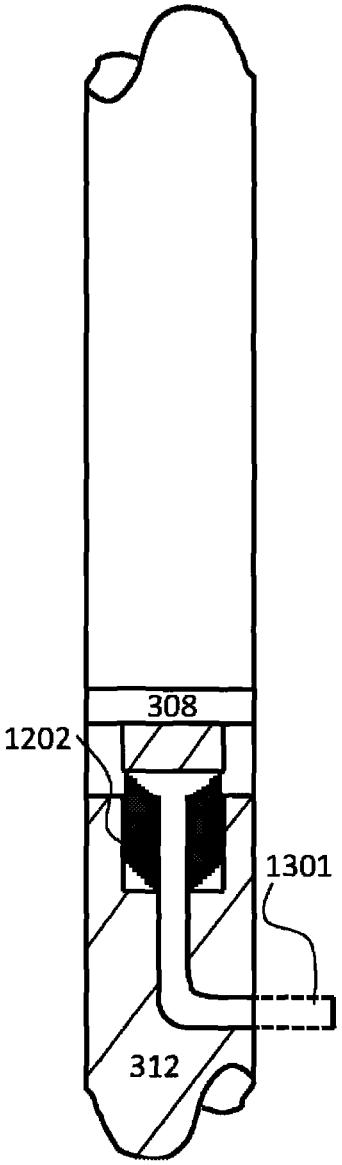

FIGS. 13A and 13B illustrates an apparatus 1300 configured with a telescoping series of tubes 1220 before (FIG. 13A) and after (FIG. 13B) the piston 308 strokes. The telescoping series of tubes allows a longer tool body 304 (and, consequently a greater volume of fluid) to be used to drill a lateral bore. As the piston 308 strokes, the telescoping series of tubes 1220 collapses, as shown in FIG. 13B. The portion 1301 of the hose that extends from the diverter sub 312 into the formation can therefore be much shorter than the length of the telescoping series of tubes 1220 that is pushed by the piston within the tool body. Therefore, adequate fluid can be supplied to achieve the drilling.

As explained above, the piston 308 serves the dual purpose of (1) pressurizing the fluid within the tool body 304 to perform the jet drilling and (2) pushing the hose into the formation during drilling. The rate that the piston strokes within the tool body is primarily determined by the pressure generated by the gas-producing fuel and the resistive pressure of the fluid within the tool body. The rate that the hose extends into the formation is primarily determined by the rate at which the piston strokes (because the piston pushes the hose into the formation). But that assumes that the rate of jet drilling is fast enough to keep up with the rate that hose extends into the formation. Depending on the drilling rate, it may be necessary to slow the stroking of the piston and thereby slow the extension of the hose into the formation. The power source output can be controlled by specifically controlling the rate of burn of the power source or by throttling the gas flow from the power source chamber through a control valve and into the fluid chamber 304*a*. The piston can be throttled or slowed by attaching geared shafts/mechanisms to the piston that create a positive force resisting the downward movement of the piston. The nozzle exits can be sized to restrict the flow volume through the nozzle 314, thus increasing the back-pressure created in the chamber with the result of slowing the piston travel. The fluid viscosity can also be increased, thereby slowing the piston travel.

Figure 14B:
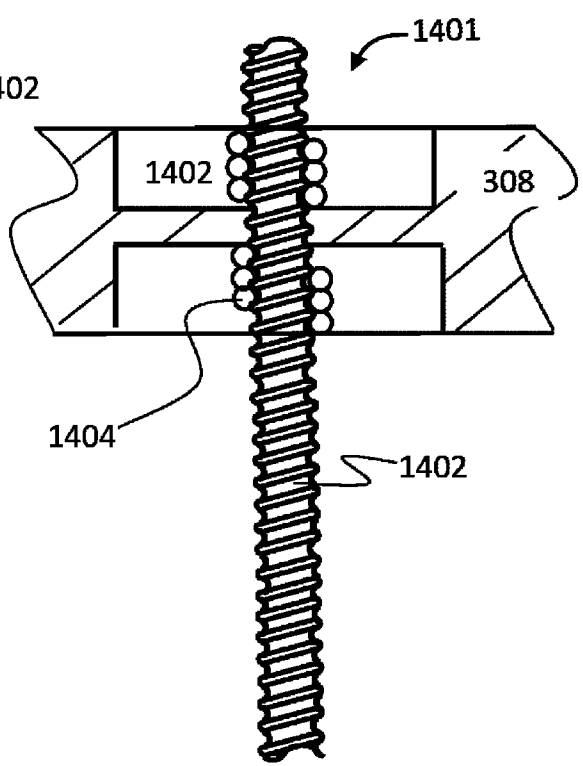
FIGS. 14A and 14B illustrate an embodiment of an in situ formation enhancement tool, having a piston governing system using linear bearings to impede the stroking speed of the piston.
Figure 14A:
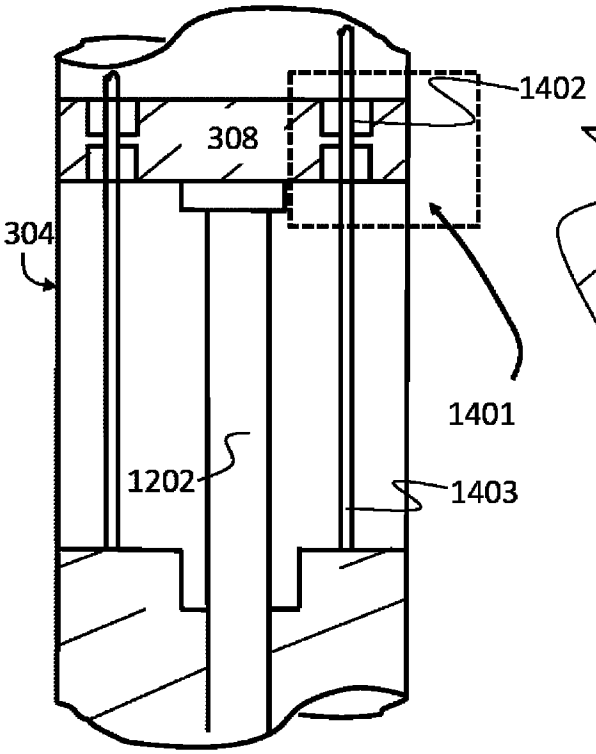

FIGS. 14A and B illustrated one embodiment for governing the piston stroke rate. As in the previously illustrated embodiments, the piston 308 strokes within the tool body 304 and collapses the telescoping series of tubes 1220. Note that the tube 1220 may be a telescoping series of tubes, as illustrated in FIG. 13, but can be drawn as a simple hose 1202 in FIG. 14A for clarity's sake. The piston 308 is modified to contain a bearing assembly 1401 that includes linear bearing housings 1402, which are shown in more detail in FIG. 14B. The linear bearing housings can ride upon stationary threaded shafts 1403. The linear bearing housings 1402 contain bearings 1404, which ride within the threads of the shaft 1403, and which translate a portion of the linear motion of the piston into radial motion of the bearings, thereby slowing the piston stroke speed.

Figure 15:
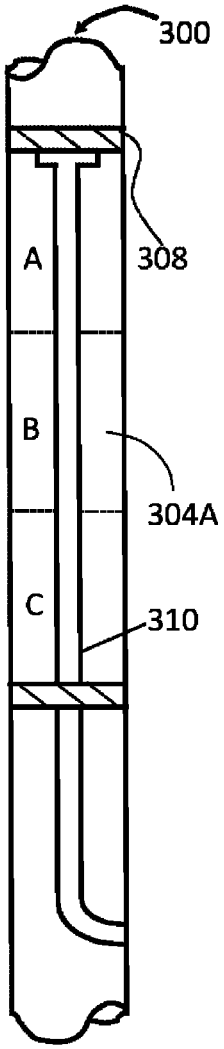
FIG. 15 illustrates an embodiment of an in situ formation enhancement tool containing jet-drilling fluids having different compositions.

According to some embodiments, the composition of the fluid within the fluid chamber 304*a* may vary along the length of the chamber. Referring to FIG. 15, the composition of fluids A, B and C, contained within the in situ formation enhancement tool 300, may differ. Therefore, as the piston 308 strokes, the composition of the fluid provided for jet drilling can vary. As the piston 308 strokes, fluid composition A will be the first fluid forced through hose 310 and provided for jet-drilling. If the well bore is cemented using acid-soluble cement, fluid A may contain an acid, for example. Fluid composition B may contain an abrasive component to facilitate jet drilling through the formation. Fluid composition C may contain a proppant material.

Variation in fluid composition can be maintained by separating the different fluid compositions using a barrier material, such as a plastic membrane. For example, the different fluids can be contained within bags, which can be loaded into the fluid chamber 304*a*. Alternatively, fluid compositions that are immiscible or that have substantially different densities or viscosities may remain separate when those fluids are simply loaded into the fluid chamber 304*a* and not allowed to mix.

As described above, high-pressure gas contained within the fluid chamber 304*a* can be vented into the lateral bore to provide a stimulating impulse once the piston 308 completes its stroke. The jet-drilling nozzle 314 may choke the release of the gas, diminishing intensity of the impulse. It can therefore be beneficial to remove the jet-drilling nozzle prior to generating the impulse. One way of doing that is to include a solid material in the fluid capable of knocking the nozzle off the hose once drilling is completed. For example, referring to FIG. 15, fluid composition C may contain metallic shot that can knock the nozzle off of the hose 310, or that can otherwise compromise the structure of the nozzle. Alternatively (or in addition), the fluid composition C may include an acid that is capable of dissolving the nozzle.

Figure 16:
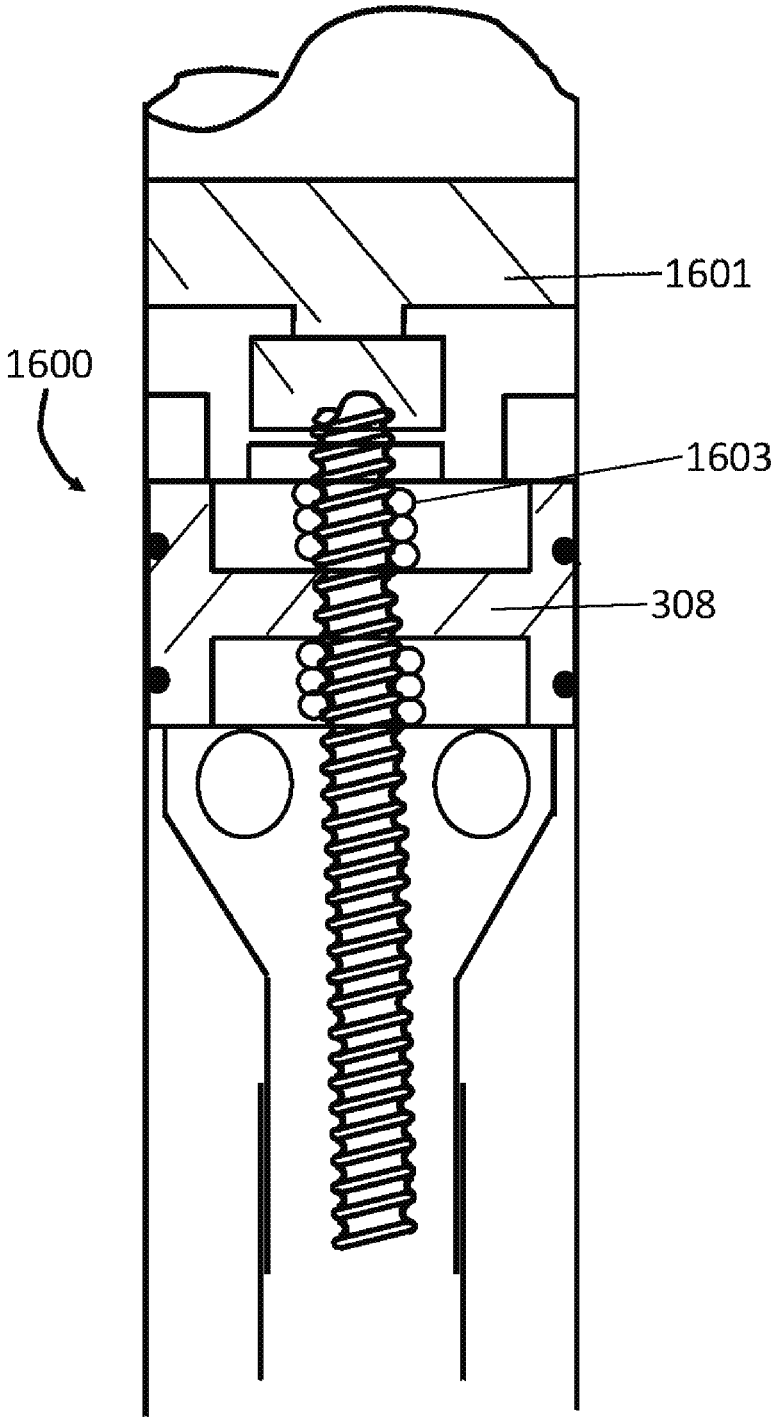
FIG. 16 illustrates an embodiment of an in situ pump powered by an electric motor.

FIG. 16 illustrates an embodiment of an apparatus 1600, wherein the piston 308 is driven by an electric motor 1601. The electric motor 1601 can be powered downhole (for example, with a battery) or can be powered from the surface using an electric line. The electric motor 1601 can turn a drive screw 1602, which causes the piston 308 to stroke. The piston 308 is equipped with drive bearings 1603.

As used herein, the term in situ formation enhancement tool generally refers to an apparatus comprising one or more of and in situ pump for providing high pressure fluid, a jet-drilling apparatus for drilling a lateral bore, and a high pressure gas source for releasing a pulse of high pressure gas. The foregoing disclosure and the showings made of the drawings are merely illustrative of the principles of this invention and are not to be interpreted in a limiting sense.

The invention claimed is:

1. An apparatus for providing pressurized fluid, comprising:

a power source body configured to contain a gas-generating fuel;

a tool body comprising a first chamber and a second chamber, wherein the first chamber is configured to hold a fluid, and the second chamber is configured to receive gas from the gas-generating fuel within the power source body;

a displacement member sealed between the first chamber and the second chamber and configured to stroke through the first chamber in response to a pressure increase within the second chamber, wherein the displacement member strokes from a first inside diameter of the tool body to a second inside diameter of the tool body that is longitudinally disposed with respect to the first inside diameter, and wherein the second inside diameter is greater than the first inside diameter and when the displacement member strokes the seal between the first chamber and the second chamber of the tool body releases; and a hose configured to generate a high-pressure jet of the fluid and to extend from the tool body, a diverter sub, or combinations thereof, when or after the displacement member is displaced or strokes through the first chamber for providing the pressurized fluid.

2. The apparatus of claim 1, further comprising a valve configured to release the gas from the second chamber through the hose when the displacement member strokes or is displaced.

3. The apparatus of claim 1, wherein one or more o-rings disposed upon the displacement member form the seal between the first chamber and second chamber, and wherein the seal is a gas-tight seal.

4. The apparatus of claim 1, further comprising an intake coupling coupled to the displacement member, wherein the intake coupling comprises ports configured to direct the fluid in the first chamber to the hose when the displacement member strokes.

5. The apparatus of claim 1, wherein the hose comprises a jet-drilling nozzle for providing the pressurized fluid into a target formation.

6. The apparatus of claim 1, wherein the diverter sub is configured to direct the hose laterally out of the apparatus as the displacement member strokes through the tool body.

7. The apparatus of claim 1, wherein the fluid comprises a viscosity modifier, a surfactant, an acid, a proppant, abrasive materials, gelled water, a bonding material, or combinations thereof.

8. The apparatus of claim 1, wherein the high-pressure jet of fluid comprises fluid that is collected, filtered, stored, pressurized, or combinations thereof, from a wellbore or a surrounding formation while the apparatus is located at penetration zone of a target formation.

9. The apparatus of claim 1, wherein a length of the hose within the tool body is at least twice as long as a length of the hose within the diverter sub, and wherein at least a portion of the length of the hose within the tool body is collapsible.

10. The apparatus of claim 1, wherein the displacement member is a piston that strokes through the first chamber for providing the pressurized fluid.

11. The apparatus of claim 1, wherein the hose is configured to be driven through a target formation by the pressurized fluid, at least one nozzle on the hose, a mechanical drive, or combinations thereof.

12. An apparatus for jet-drilling a downhole production formation, comprising:

a tool body configured to be placed in a cased and perforated wellbore within the downhole production formation;

at least one chamber within the tool body configured to contain a fluid;

a piston initially positioned at one end of the at least one chamber and configured to stroke through a length of the at least one chamber; and a jet-drilling nozzle, wherein the stroking of the piston forces the fluid through the jet-drilling nozzle and into the downhole production formation, and wherein the piston is configured to enable a release of high-pressure gas into the downhole production formation after the fluid is forced into the downhole production formation.

13. The apparatus of claim 12, wherein the jet-drilling nozzle is removed from the apparatus prior to the release of the high-pressure gas.

14. The apparatus of claim 12, wherein the jet-drilling nozzle is configured to be removed from the apparatus by passing a solid material through the hose, passing a metallic material through the hose, passing an acid through the hose, or combinations thereof.

15. The apparatus of claim 12, wherein the jet-drilling nozzle comprises any number of orifices, any size of orifices, any configuration, and any shape of orifices for forcing the fluid into the downhole production formation.

16. The apparatus of claim 12, wherein a number of orifices on the jet-drilling nozzle, sizes of the orifices on the jet-drilling nozzle, a ratio of the number of orifices on a leading edge to a number of orifices on a trailing edge of the jet-drilling nozzle controls pressure of the pressurized fluid, a forward travel rate of the jet-drilling nozzle, and a cutting or perforating penetration of the jet-drilling nozzle.

17. The apparatus of claim 12, wherein the at least one chamber is configured to contain the drilling fluid used for jet-drilling, wherein a second chamber is configured to contain the fuel used to pressurize the jet-drilling performed by the apparatus within the wellbore.

18. A method of generating a jet of high pressure fluid within a wellbore, comprising:

activating a gas-generating fuel contained within a fuel chamber of a downhole tool to produce an expanding gas;

pressurizing a gas-expansion chamber of the downhole tool with the expanding gas;

stroking a displacement member through a fluid chamber configured to hold a fluid, wherein the displacement member strokes due to pressurizing of the gas-expansion chamber and causes pressurizing of the fluid; and jetting the fluid out of an outlet of the downhole tool in response to the pressurizing of the fluid, wherein the jetting of the fluid creates a bore in a production formation surrounding the wellbore;

removing a jet-drilling nozzle from the outlet by passing a solid material through the hose, passing a metallic material through the hose, passing an acid through the hose, or combinations thereof; and releasing the expanding gas after removing the jet-drilling nozzle.

19. The method of claim 18, wherein the step of creating the bore comprises extending a hose into the bore to enlarge the bore for forcing the fluid into the production formation, wherein the hose extends into the bore from a tool body, a diverter sub, or combinations thereof.

20. The method of claim 18, further comprising stimulating the production formation by releasing the expanding gas from the outlet after the fluid has been jetted.

21. The method of claim 18, wherein releasing the expanding gas comprises releasing the expanding gas through a valve in the displacement member, releasing the expanding gas around the displacement member, or combinations thereof.

22. The method of claim 18, further comprising performing well logging to produce logging data for identifying a target formation to create the bore and using the logging data to position the downhole tool at the target formation for creating the bore.

23. The method of claim 22, further comprising using the logging data for re-entry of the downhole tool or a second downhole tool at prior target formation or the bore.

24. The method of claim 18, further comprising the method steps of deploying a positioning tool within a wellbore at a site of a target formation, wherein the positioning tool comprises a selective profile; and latching the downhole tool into the positioning tool, wherein the downhole tool comprises a profile complementary to the selective profile of the positioning tool for positioning the downhole tool at the target formation.

25. The method of claim 24, further comprising using logging data, the positioning tool, or combinations thereof for re-entry of the downhole tool or a second downhole tool at prior target formation or the bore.

26. The method of claim 18, wherein the displacement member is a piston or a crush cylinder.

27. A method of generating a jet of high pressure fluid within a wellbore, comprising:

activating a gas-generating fuel contained within a fuel chamber of a downhole tool to produce an expanding gas;

pressurizing a gas-expansion chamber of the downhole tool with the expanding gas;

stroking a piston through a fluid chamber configured to hold a fluid, wherein the piston strokes due to pressurizing of the gas-expansion chamber;

jetting the fluid out of an outlet of the downhole tool in response to the stroking of the piston, wherein the jetting of the fluid creates a bore in a production formation surrounding the wellbore; and releasing the expanding gas from the outlet after the fluid has been jetted by releasing the expanding gas through the piston, releasing the expanding gas around the piston, or combinations thereof.

28. An apparatus for providing pressurized fluid, comprising:

a power source body configured to contain a gas-generating fuel;

a tool body comprising a first chamber and a second chamber, wherein the first chamber is configured to hold a fluid, and the second chamber is configured to receive gas from the gas-generating fuel within the power source body;

a displacement member sealed between the first chamber and the second chamber and configured to stroke through the first chamber in response to a pressure increase within the second chamber;

a hose configured to generate a high-pressure jet of the fluid and to extend from the tool body, a diverter sub, or combinations thereof, when or after the displacement member is displaced or strokes through the first chamber for providing the pressurized fluid; and a vent or a valve configured to release the gas from the second chamber through the hose when the displacement member strokes or is displaced.

29. An apparatus for jet-drilling a downhole production formation, comprising:

a tool body configured to be placed in a cased and perforated wellbore within the downhole production formation;

at least one chamber within the tool body configured to contain a fluid, a material or combinations thereof;

a piston initially positioned at one end of the at least one chamber and configured to stroke through a length of the at least one chamber; and a jet-drilling nozzle, wherein the stroking of the piston forces the fluid through the jet-drilling nozzle and into the downhole production formation, wherein the jet-drilling nozzle is configured to be removed from the apparatus by passing a solid material through the hose, passing a metallic material through the hose, passing an acid through the hose, or combinations thereof.

30. A method of generating a jet of high pressure fluid within a wellbore, comprising:

activating a gas-generating fuel contained within a fuel chamber of a downhole tool to produce an expanding gas;

pressurizing a gas-expansion chamber of the downhole tool with the expanding gas;

stroking a displacement member through a fluid chamber configured to hold a fluid, wherein the displacement member strokes due to pressurizing of the gas-expansion chamber and causes pressurizing of the fluid; and jetting the fluid out of an outlet of the downhole tool in response to the pressurizing of the fluid, wherein the jetting of the fluid creates a bore in a production formation surrounding the wellbore, and wherein the production formation is stimulated by releasing the expanding gas from the outlet after the fluid has been jetted.

* * * * *